United States Patent [19]

Hohmann et al.

[11] 4,257,520

[45] Mar. 24, 1981

[54] INTEGRAL AMMUNITION BUNKER

[75] Inventors: Claus Hohmann, Donauwörth; Wolfgang Glück, Kissing, both of Fed. Rep. of Germany

[73] Assignee: Messerschmitt-Bölkow-Blohm Gesellschaft mit beschränkter Haftung, Munich, Fed. Rep. of Germany

[21] Appl. No.: 57,432

[22] Filed: Jul. 13, 1979

[30] Foreign Application Priority Data

Jul. 25, 1978 [DE] Fed. Rep. of Germany ..... 2832573

[51] Int. Cl.[3] ..... F42B 37/00; F42B 39/00; B65D 81/00; B65D 1/36

[52] U.S. Cl. ..... 206/3; 206/443; 220/21

[58] Field of Search ..... 206/3, 443; 220/21, 220/22

[56] References Cited

U.S. PATENT DOCUMENTS

| | | | |
|---|---|---|---|
| 2,420,663 | 5/1947 | Heath et al. | 220/21 |
| 2,928,530 | 3/1960 | Sauey | 206/3 |
| 3,101,840 | 8/1963 | Canning, Jr. et al. | 206/3 |
| 3,245,573 | 4/1966 | Bakos | 220/21 |

*Primary Examiner*—William T. Dixson, Jr.
*Attorney, Agent, or Firm*—Toren, McGeady and Stanger

[57] ABSTRACT

An integrally formed ammunition bunker is manufactured in a single integral unit from plastic material, with the overall structure including individual tubular containers arranged adjacent each other surrounded by a common outer casing, with webs extending between the tubular containers, and with the entire structure being cast as a one-piece plastic object.

3 Claims, 3 Drawing Figures

INTEGRAL AMMUNITION BUNKER

BACKGROUND OF THE INVENTION

The present invention relates generally to armament storage devices and more particularly to an ammunition bunker of the type wherein explosive materials may be stored.

Containers of the type to which the present invention relates adapted to receive therein ammunition are, as a rule, arranged so that the ammunition is held in the manner of an individual packaging element with the packings containing the ammunition being stacked in the form of a bunker. The packaged parts of these bunkers are usually produced individually and they are then joined together in an assembly process. This is usually true in the case where the packing parts are made of plastic material and wherein, at most, smaller units are combined into an integral structural component and are manufactured in this manner and subsequently joined together to form the overall ammunition bunker.

The reason for the foregoing approach is found to be primarily due to the fact that, when structural units are overly large, there arises a danger of premature hardening or of instability during the production procedure which danger is relatively high and which thus causes unacceptable waste to occur.

Compared with the differential construction, an integral construction approach will reduce total expenses for production but it will still not be reduced to an optimum degree.

Moreover, in the design of bunkers it must be primarily assumed that the design should be oriented on the construction so that forces acting on the entire completed ammunition bunker cannot be conducted through paths and over sections which would represent an optimum with respect to static considerations. Other consequences involve weight increases. Additionally, material desired for reasons of ballistic considerations are not always usable or not always usable without special considerations because, in the required manner of construction, they frequently can only be assembled under great difficulty and they therefore cannot be manufactured economically.

Accordingly, the present invention is directed primarily toward achievement of a reduction in the required individual parts of an ammunition bunker in order to decrease assembly expenses thereof while simultaneously facilitating a structure in which the forces are absorbed in an optimum manner. In this regard, discontinuities and notches are to be avoided in the cross sections of the structure, and the integral construction should be as large as possible with the construction being self-supporting or at least jointly supporting.

SUMMARY OF THE INVENTION

Briefly, the present invention may be described as an ammunition bunker of the type wherein the prior art problems are overcome by a construction comprising an ammunition bunker consisting of only a single integral component so that the expenses for respective assembly operation are reduced to a minimum. The bunker structure of the present invention may be manufactured by a casting method which may comprise either a gravity casting method which is known per se or an injection molding method.

In an ammunition bunker produced in accordance with the present invention, the disadvantages described above with regard to the state of the art are essentially avoided and accordingly, the task is solved whereby problems are reduced and advantages are provided.

DETAILED DESCRIPTION OF THE PREFERRED EMBODIMENTS

Figure 1:
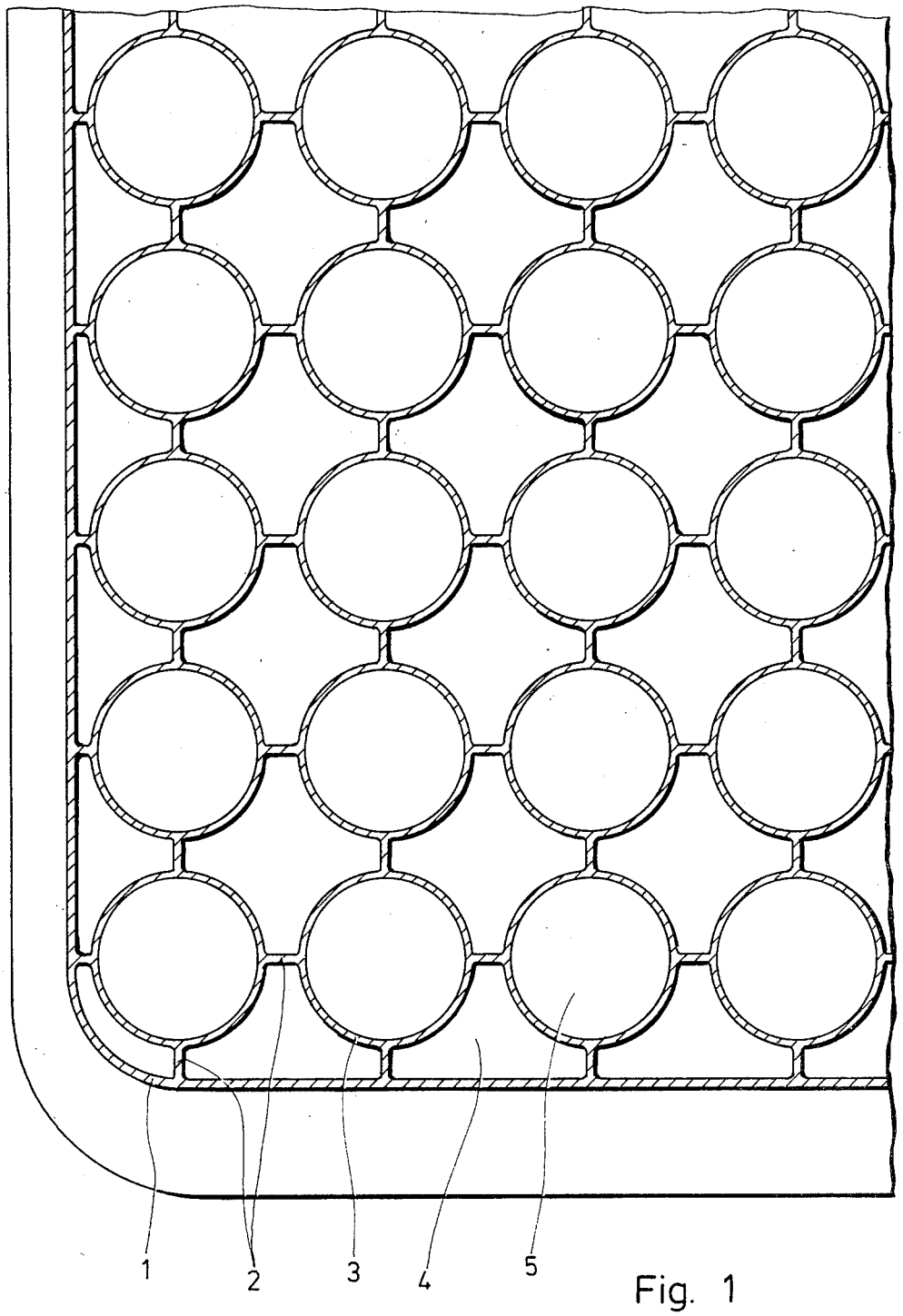
FIG. 1 is a cross sectional view taken through a portion of an ammunition bunker formed in accordance with the present invention.
Figure 2:
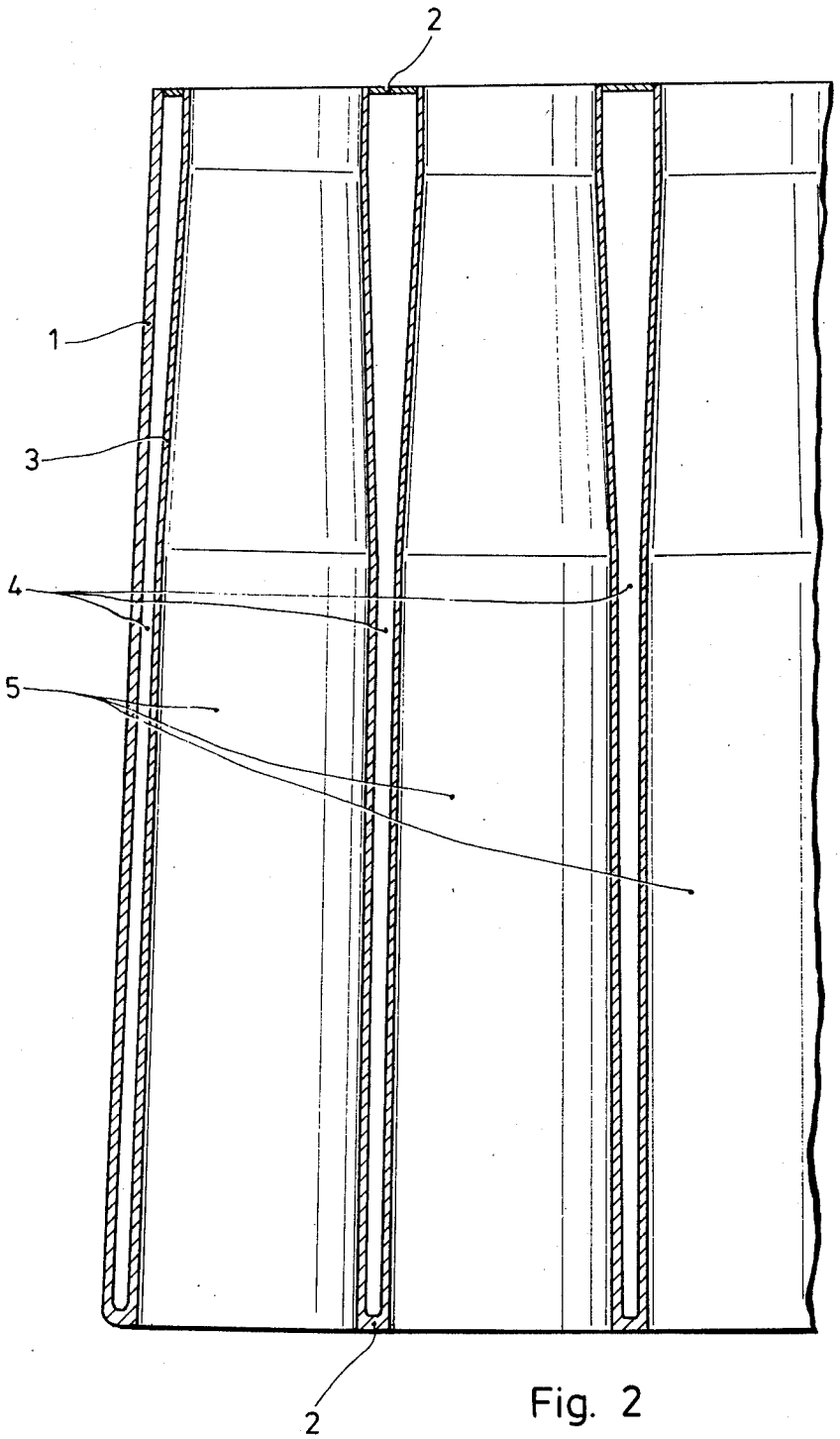
FIG. 2 is a partial longitudinal sectional view taken through the ammunition bunker of FIG. 1.

Referring now to FIGS. 1 and 2, an ammunition bunker in accordance with the present invention is formed to consist of a number of hollow cylinders 5 adapted to receive ammunition (not shown) therein. The hollow cylinders 5 are formed of tubes 3 having cross sections which are in the shape of circular rings and which are fixed by means of webs 2 so that they are spaced relative to each other and relative to a surrounding outer jacket 1.

Hollow spaces 4 remain between the individual tubes 3 and the hollow spaces remaining therebetween may serve to receive special protective devices, for example, in accordance with a proposal disclosed in the protective arrangement of German patent application No. P 27 35 796.6.

The partial section illustrated in FIG. 2 shows the outer jacket 1 together with the tubes 3 which form the hollow cylinder 5. The webs 2 and the hollow spaces 4 are also clearly shown and it will be seen that the tubes 3 are integrally joined together by the webs 2.

Figure 3:
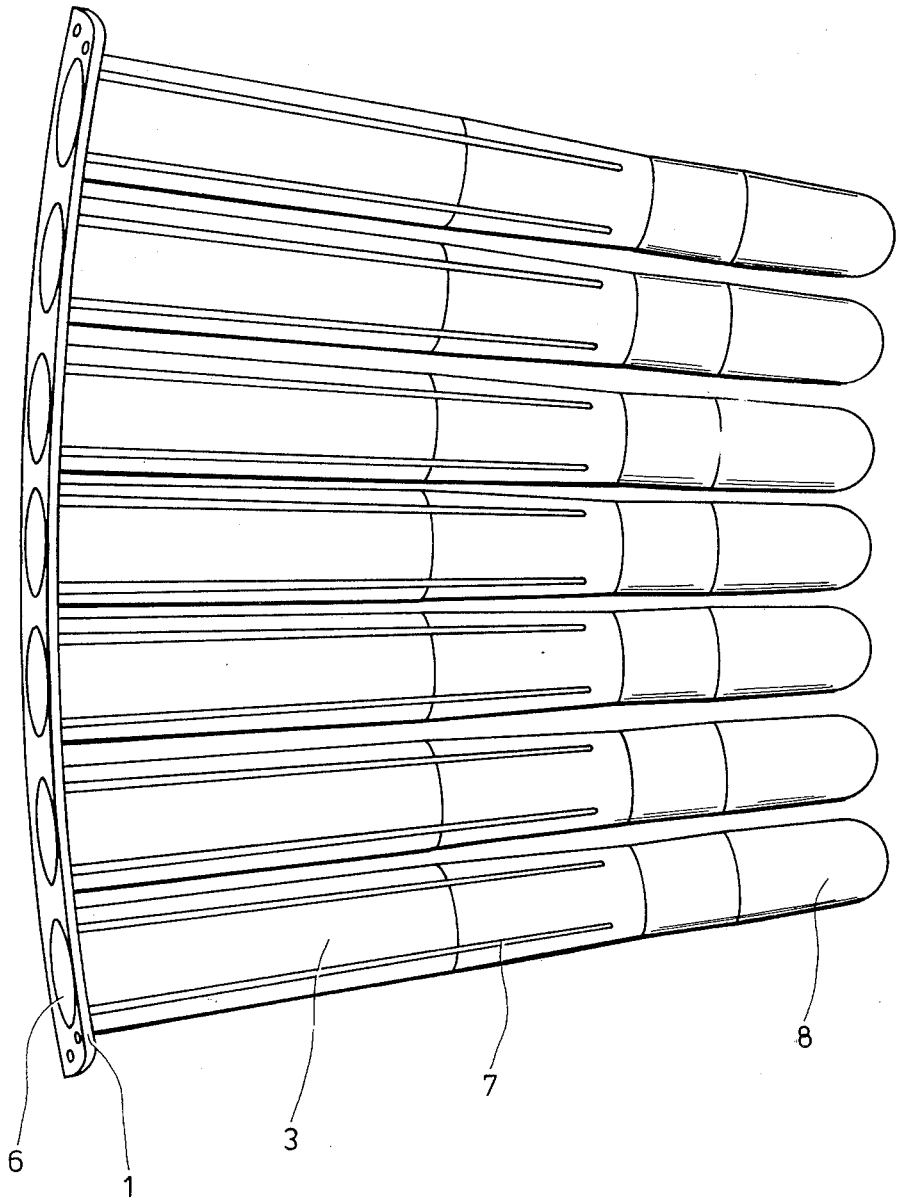
FIG. 3 is a generally perspective view showing in integral construction a group of tubes forming an ammunition bunker devoid of an outer bunker casing with the view being taken generally perpendicular to the central axis of the ammunition.

Referring now to FIG. 3, a group of tubes of an ammunition bunker are illustrated which show breakthroughs 6 through the outer jacket toward the tubes 3, the tubes 3 being reinforced by means of stiffening webs 7. At their ends opposite the breakthroughs 6, the tubes 3 are formed with hemispherical closures comprising caps 8.

In the example for a design of an ammunition bunker in accordance with the invention as illustrated in the drawings, and particularly in accordance with FIG. 3, the parts 1, 3, 6, 7 and 8 are produced from plastic material by a casting method which may be known per se in order to form the structure as a single-piece integral part which may be subsequently joined together with other similar parts to form an ammunition bunker. Accordingly, there remains only the simple assembly operation of joining together a few integral components to form an ammunition bunker, it being no longer necessary to make the ammunition bunker by individually assembling a plurality of cylinders such as the hollow cylinders 5, the webs 3 and the outer jacket 1.

The cross sections of the individual parts may be optimized in a desired manner exactly in accordance with static and dynamic requirements without thereby increasing costs of production.

While specific embodiments of the invention have been shown and described in detail to illustrate the application of the inventive principles, it will be understood that the invention may be embodied otherwise without departing from such principles.

What is claimed is:

1. An ammunition bunker comprising a plurality of individual tubular members each arranged adjacent each other and adapted to receive ammunition therein, and webs connecting all of said individual tubular members together, said bunker being essentially formed in its totality as an integral cast piece composed entirely of plastic material.

2. A bunker according to claim 1 further comprising an outer casing portion entirely surrounding said plurality of tubular members and said webs and cast as an integral part thereof from identical material.

3. A bunker according to claim 2 configured to provide hollow spaces between each of said individual tubular members and the webs connecting said members, said hollow spaces being located within said outer casing portion and being adapted to receive protection means.

* * * * *